US010094621B2

(12) United States Patent
Van De Broek

(10) Patent No.: US 10,094,621 B2
(45) Date of Patent: Oct. 9, 2018

(54) SPIRAL OR HELICAL COUNTERFLOW HEAT EXCHANGER

(71) Applicant: POLYVISION, NAAMLOZE VENNOOTSCHAP, Genk (BE)

(72) Inventor: Wout Van De Broek, Hamont-Achel (BE)

(73) Assignee: POLYVISION, NAAMLOZE VENNOOTSCHAP, Genk (BE)

( * ) Notice: Subject to any disclaimer, the term of this patent is extended or adjusted under 35 U.S.C. 154(b) by 288 days.

(21) Appl. No.: 14/649,107

(22) PCT Filed: Dec. 4, 2013

(86) PCT No.: PCT/BE2013/000063

§ 371 (c)(1),
(2) Date: Jun. 2, 2015

(87) PCT Pub. No.: WO2014/085874

PCT Pub. Date: Jun. 12, 2014

(65) Prior Publication Data

US 2015/0330714 A1 Nov. 19, 2015

(30) Foreign Application Priority Data

Dec. 5, 2012 (BE) ..... 2012/0822

(51) Int. Cl.
*F28D 7/12* (2006.01)
*F28D 7/02* (2006.01)
(Continued)

(52) U.S. Cl.
CPC ..... *F28D 9/04* (2013.01); *F28D 7/022* (2013.01); *F28D 9/00* (2013.01); *F28D 9/0062* (2013.01); *F28F 19/02* (2013.01)

(58) Field of Classification Search
CPC ..... F28D 7/022; F28D 9/00; F28D 9/0062; F28D 9/04; B21D 53/027; F24J 2/246; F24J 2/207
(Continued)

(56) References Cited

U.S. PATENT DOCUMENTS 2,136,153 A 11/1938 Fredrik

FOREIGN PATENT DOCUMENTS

DE 10 55 487 B 4/1959
DE 23 01 222 A1 7/1974
(Continued)

OTHER PUBLICATIONS

English Translation of EP 0214589A1.*
(Continued)

*Primary Examiner* — Len Tran
*Assistant Examiner* — Paul Alvare
(74) *Attorney, Agent, or Firm* — Young & Thompson

(57) ABSTRACT

Spiral or helical counterflow heat exchanger (9, 9') consisting of two adjoining chambers (10,11), in which a fluid at a high temperature flows in one chamber in one direction, and in which a fluid at a low temperature flows in the opposite direction in the other chamber, characterized in that both chambers are separated by one separating plate (6') of flat monolithic double-sided enamelled steel annealed at temperatures above 500° C., and whereby the separating plate (6') is held by its edges in a corrosion-resistant spacer (8,8') that imposes a fixed distance to two other flat monolithic double-sided enamelled steel plates that each define one chamber at the side that is opposite the separating plate (6'), and which prevents corrosion of the edges of the separating plate and of the two other enamelled steel plates.

2 Claims, 8 Drawing Sheets

(51) Int. Cl.

| | |
|---|---|
| ***F28F 3/12*** | (2006.01) |
| ***F28D 9/04*** | (2006.01) |
| ***F28F 19/02*** | (2006.01) |
| ***F28D 9/00*** | (2006.01) |

(58) Field of Classification Search
USPC ..... 165/164, 169
See application file for complete search history.

(56) References Cited

FOREIGN PATENT DOCUMENTS

| | | | | | |
|---|---|---|---|---|---|
| DE | 2829959 | A1 | * | 1/1980 | |
| DE | 34 05 768 | A1 | | 8/1985 | |
| DE | 40 31 355 | A1 | | 4/1992 | |
| EP | 0061779 | A2 | * | 10/1982 | ..... B21D 53/027 |
| EP | 0 214 589 | A1 | | 3/1987 | |
| EP | 0 566 208 | A1 | | 10/1993 | |
| FR | 2 963 415 | A1 | | 2/2012 | |
| GB | 1 273 305 | A | | 5/1972 | |
| JP | S6033490 | A | * | 2/1985 | |
| JP | S61 101797 | A | | 5/1988 | |
| JP | S63 135790 | A | | 6/1988 | |
| JP | 2000 074577 | A | | 3/2000 | |
| JP | 2004 060906 | A | | 2/2004 | |

OTHER PUBLICATIONS

English Translation of DE 4031355 A1.*
Translation of Japanese Patent Document JPS6033490A entitled Translation—JPS6033490A.*
Translation of German Patent Document DE2829959A1 entitled Translation—DE2829959A1.*
Translation of EP 0061779 A2 entitled Translation—EP 0061779 A2.*
International Search Report, dated Jul. 21, 2014, from corresponding PCT application.

* cited by examiner

SPIRAL OR HELICAL COUNTERFLOW HEAT EXCHANGER

BACKGROUND OF THE INVENTION

Field of the Invention

The present invention relates to heat exchangers.

More specifically, the invention is intended to obtain helical heat exchangers that make use of enameled steel.

Description of the Related Art

The useful properties of enameled steel are generally known, such as a high corrosion resistance, high resistance to wear and a high chemical resistance.

The use of enameled steel in heat exchangers is also known on account of the above-mentioned qualities and also because such surfaces of enameled steel are maintenance-friendly and resistant to high temperatures. Moreover, enameled steel is thermally efficient for heat conduction due to the thinness of the ceramic layers.

The use of double-sided enameled and corrugated steel plate is standard in air preheaters and gas-gas heat exchangers in industrial processes, such as in a desulphurisation installation for combustion gases.

These heat exchangers take on the form of large cages that are filled with corrugated double-sided enameled steel with a large contact area with the gas with which it is brought into contact.

The heat exchangers consist of a number of cages filled with enameled sheet steel, which together yield a heat exchanging area of 30,000 $m^2$. In this application the enameled steel is exposed to corrosion by the corrosive flue gases, and it must be chemically resistant but also a good thermal conductor.

These heat exchangers are of the regenerative type, which means that they will absorb heat for a certain time from a gas flow that is carried across half of the heat exchanger, after which this half is rotated away and cooled in another gas flow, until it has sufficiently cooled in order to be used again for the absorption of heat from the first gas flow, which is obtained by a subsequent rotation.

A typical example was described by A. Chelli et al. in XXI International Enamellers Congress, 18-22 May 2008 in Shanghai, p. 126-154. In this example two rotary heat exchangers with enameled steel are applied as a heat exchanger in the same industrial desulphurisation process for flue gases.

A disadvantage of these heat exchangers with corrugated double-sided enameled sheet steel in the current form is that they cannot be used as a counterflow heat exchanger in a continuous heat-exchanging process.

Another disadvantage of these heat exchangers is that they expose the corrugated double-sided enameled sheet steel to frequent high temperature fluctuations on account of their regenerative function.

Another disadvantage of these heat exchangers is that they are not static and thereby present a greater risk of mechanical failure and a lower thermal efficiency than static heat exchangers.

Among the static heat exchangers, the counterflow heat exchangers in particular are very thermally efficient.

In this application a hot fluid (gas or liquid) is guided through a heat exchanger in one direction and a cold fluid in the other direction, separated by a thermally conductive wall, through which the hot fluid transfers heat to the cold fluid.

These counterflow heat exchangers are even more thermally efficient if, instead of flat chambers that are separated by a flat wall, they consist of a first spiral or helical chamber through which a first fluid flows, which is surrounded along both sides by a second spiral or helical chamber through which a second fluid flows in the opposite direction, separated by spiral walls between the two flow directions.

Spiral counterflow heat exchangers have been described in EP 0.214.589 and in U.S. Pat. No. 2,136,153, but their plates are not made of enameled steel and do not have corrosion resistant spacers.

For such applications, the known corrugated double-sided enameled steel plate is not suitable for a partition wall, because it is not flat and moreover cannot be wound in a spiral or helix.

For such applications on the other hand thin flexible double-sided enameled steel plate is indeed a suitable material, on account of its malleability, thermal conductivity and its corrosion-resistant surface.

BRIEF SUMMARY OF THE INVENTION

The purpose of the present invention is to provide a solution to the aforementioned and other disadvantages, by providing a helical counterflow heat exchanger that makes use of flat thin double-sided enameled steel plate.

To this end, the invention concerns a helical counterflow heat exchanger consisting of two adjoining chambers, in which a fluid at a high temperature flows in one chamber in one direction, and in which a fluid at a lower temperature flows in the opposite direction in the other chamber, whereby both chambers are separated by one separating plate of monolithic double-sided enameled flat steel annealed at temperatures above 500° C., and whereby the separating plate is held by its edges in a corrosion-resistant spacer that imposes a fixed distance to two other monolithic double-sided enameled flat steel plates that each define one chamber at the side that is opposite the separating plate, and which prevents corrosion of the edges of the separating plate and of the two other enameled steel plates.

An advantage of such a counterflow heat exchanger is that the thermally conductive wall between the two chambers is enameled on both sides and is smooth, which protects the wall surface against corrosion, but also makes the wall maintenance-friendly because it is smooth and easy to clean.

Another advantage is that such a thermally conductive wall is very thermally efficient and can also be produced at a low cost.

Another advantage of such a thermally conductive wall is that it can be very long, as the double-sided enameled steel plate can be produced in long continuous bands, whereby a total length of approximately 150 meters is possible.

An additional advantage of such a heat exchanger is that the steel plate is already enameled before assembly of the heat exchanger, such that no complex shapes such as helical heat exchangers have to be enameled. The exceptional flexibility of the thin enameled sheet steel enables the heat exchangers to be assembled after enameled, which greatly simplifies their production.

A specific advantage of this type of counterflow heat exchanger is that the flow can proceed unimpeded because the surfaces of the double-sided enameled partition walls between the chambers are completely flat and smooth and do not offer any resistance to a fast flow of the two fluids.

An advantage of such a spacer is that it not only protects the edges of the double-sided enameled steel plate that are the most vulnerable to corrosion, but it also ensures that the two enameled steel plates that define the chamber of the heat exchanger are at the same distance from one another everywhere.

Another type of corrosion-resistant spacer with which a stack of flat double-sided enameled steel plates can be separated consists of beam-shaped or round strips of Teflon or another chemically inert material, which extend in the flow direction of the fluids between two flat double-sided enameled steel plates stacked parallel to one another, and are so arranged that the edges of the steel plates do not come into contact with the content of the flow chambers created, and such that the edges are not susceptible to corrosion from corrosive fluids. Only the inside of the chambers, which are defined by enameled steel and Teflon or another chemically inert material, come into contact with the fluids.

A preferred embodiment of the counterflow heat exchanger is the helical counterflow heat exchanger, constructed from three flexible double-sided enameled steel plates that define two chambers and are wound helically around a central longitudinal axis. A first fluid is guided by the first chamber 10 and a second fluid is guided in the opposite direction by the second chamber 11. A helical spacer 18 imposes the mutual distance and the curve of the windings in the enameled steel plates.

This helical counterflow heat exchanger can be provided with an additional type of spacer that consists of beam-shaped or round strips 8" of Teflon or another chemically inert material, that extend in the flow direction of the fluids between the three helical double-sided enameled steel plates wound around one other, and are arranged such that the edges of the steel plates do not come into contact with the content of the flow chambers 10, 11 defined by the beam-shaped or round strips 8".

An advantage of this helical counterflow heat exchanger is that it is of a compact form and can be built around a central cylindrical space, while the inside surface of the flow chambers remains seamless, and enables an unhindered flow of the fluids. The inert and smooth inside surface of the chambers also enables better maintenance, by regularly washing these spaces with cleansing agents suitable for this purpose.

BRIEF DESCRIPTION OF THE DRAWINGS

With the intention of better showing the characteristics of the invention, one preferred embodiment of counterflow heat exchangers according to the invention is described hereinafter by way of an example, without any limiting nature, with reference to the accompanying drawings, wherein.

DETAILED DESCRIPTION OF THE PREFERRED EMBODIMENTS

Figure 1:
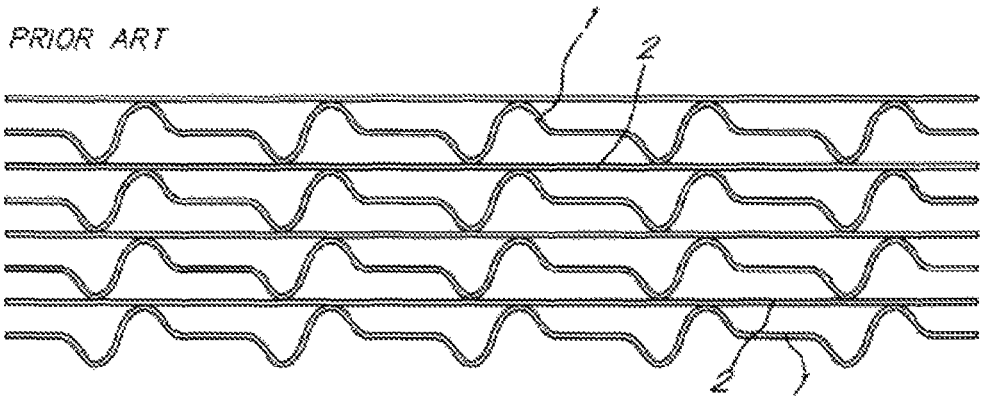
FIG. 1 schematically shows a cross-section of a set of corrugated double-sided enameled steel plates in a regenerative heat exchanger according to the state of the art.

FIG. 1 schematically shows a cross-section of a number of corrugated double-sided enameled steel plates, as used in cages for regenerative heat exchangers in the current state of the art. In this case, a cold-rolled corrugated steel plate 1 that is enameled on both sides is alternated with a flat double-sided enameled steel plate 2.

Figure 2:
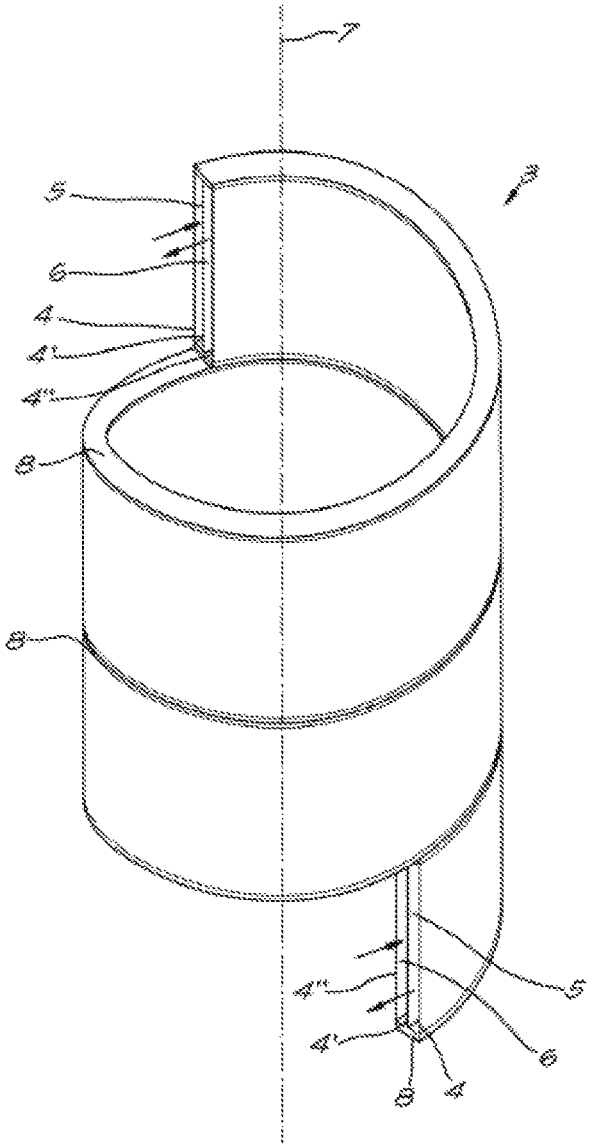
FIG. 2 shows a helical counterflow heat exchanger comprising three double-sided enameled flexible plates according to the invention.

FIG. 2 shows a helical counterflow heat exchanger 3 made up of three flexible double-sided enameled steel bands 4, 4' 4" that define two chambers 5, 6 and are wound helically around a central longitudinal axis 7. A first fluid is guided through the first chamber 5 and a second fluid is guided in the opposite direction through the second chamber 6. A first helical spacer 8 imposes the mutual distance and the curve of the windings in the enameled steel plates.

Figure 3:
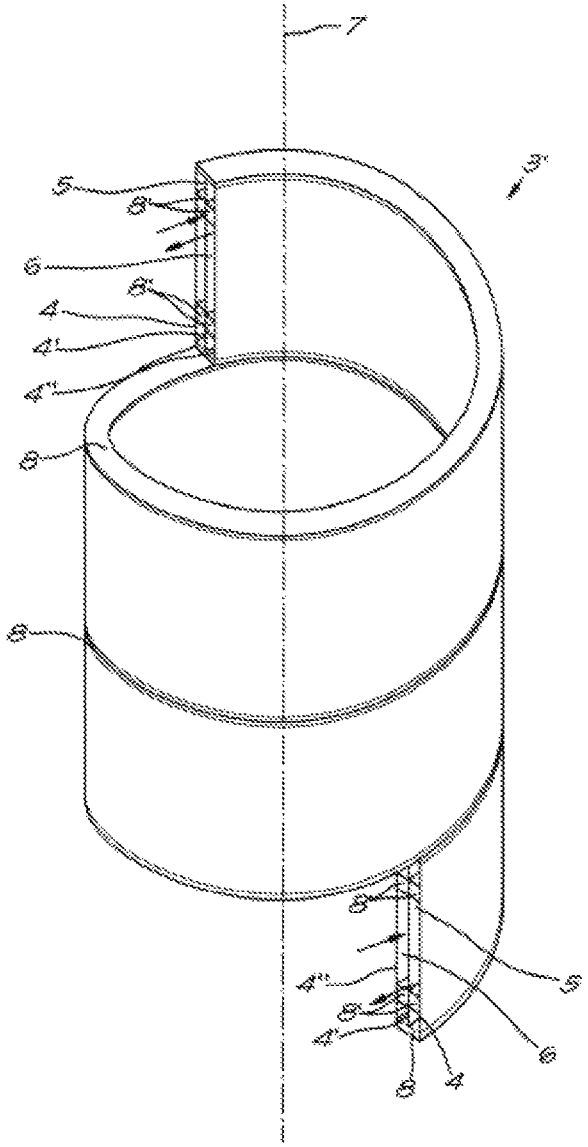
FIG. 3 shows a variant of FIG. 2 with a different type of spacer.
Figure 4:
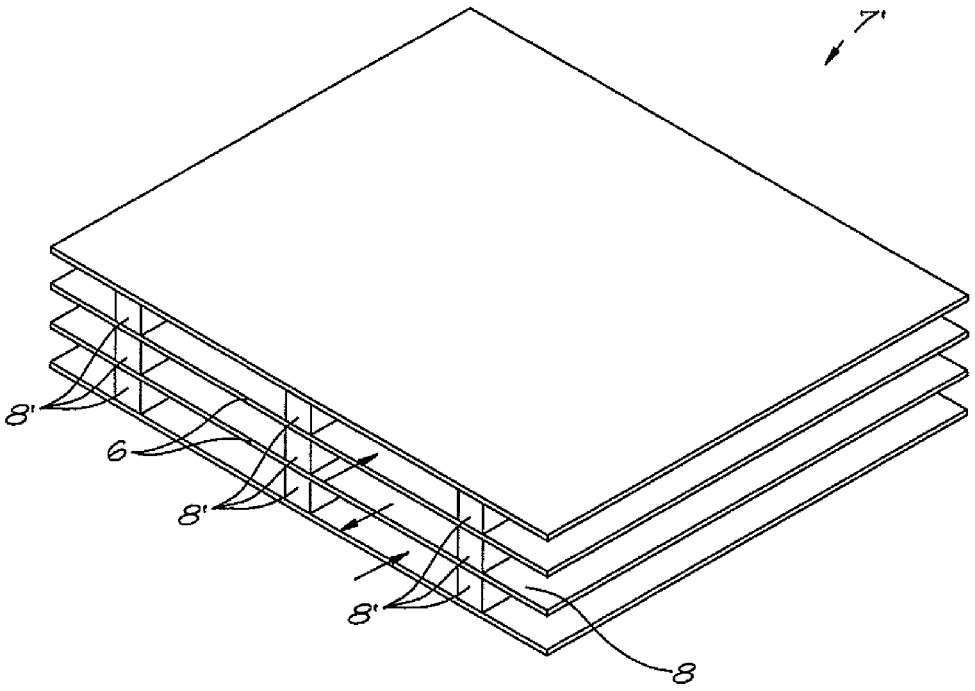
Figure 5:
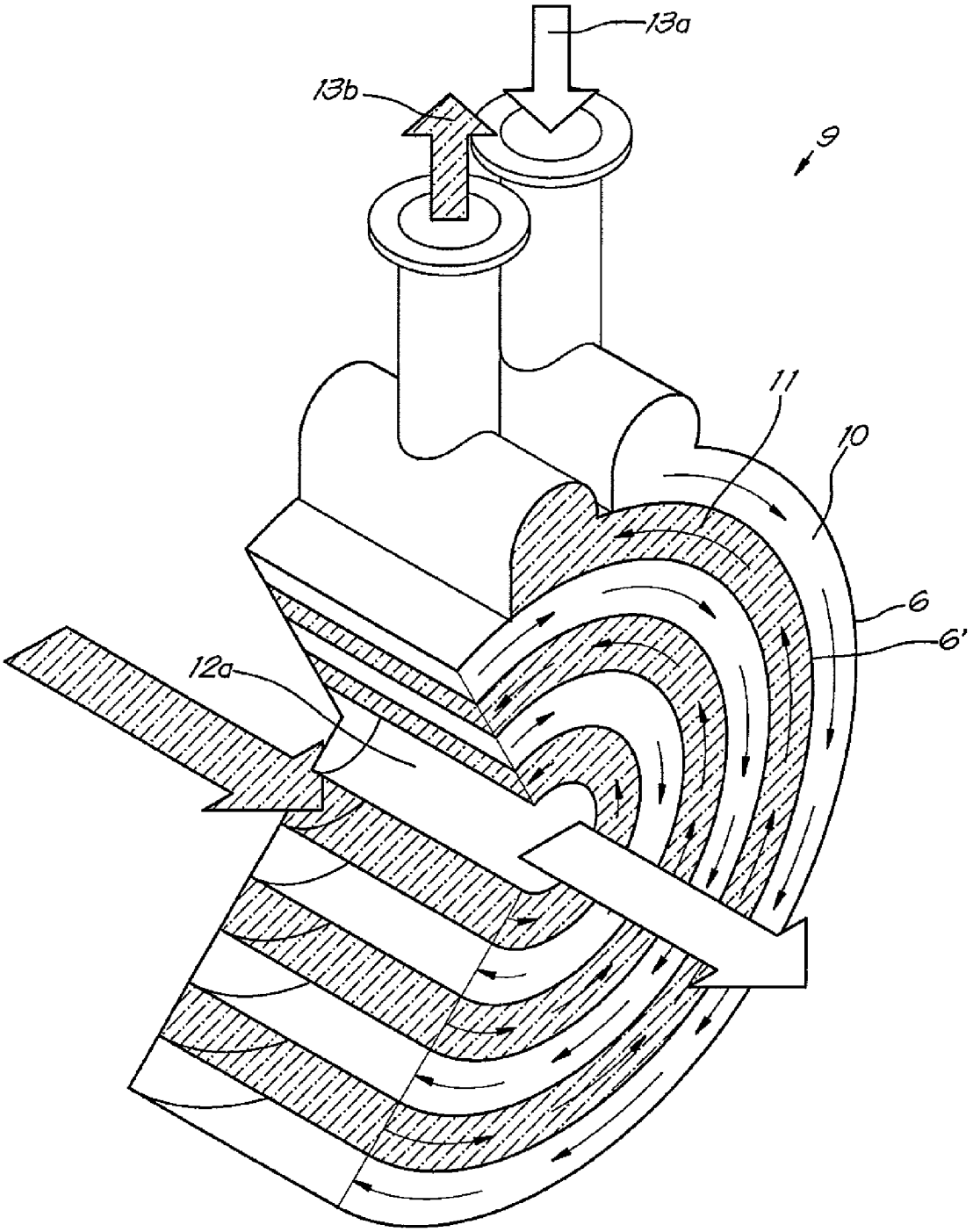
Figure 6:
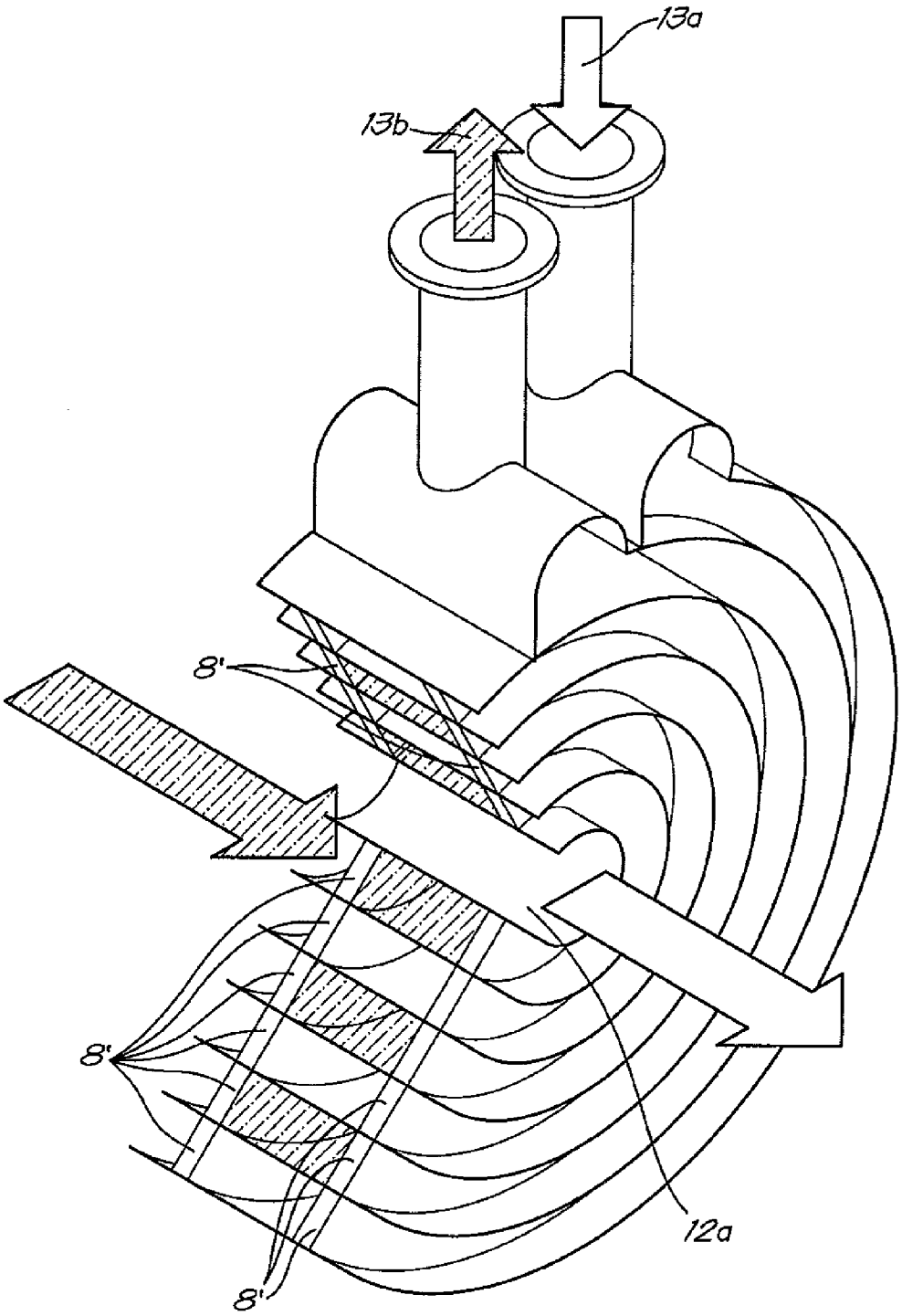
Figure 7:
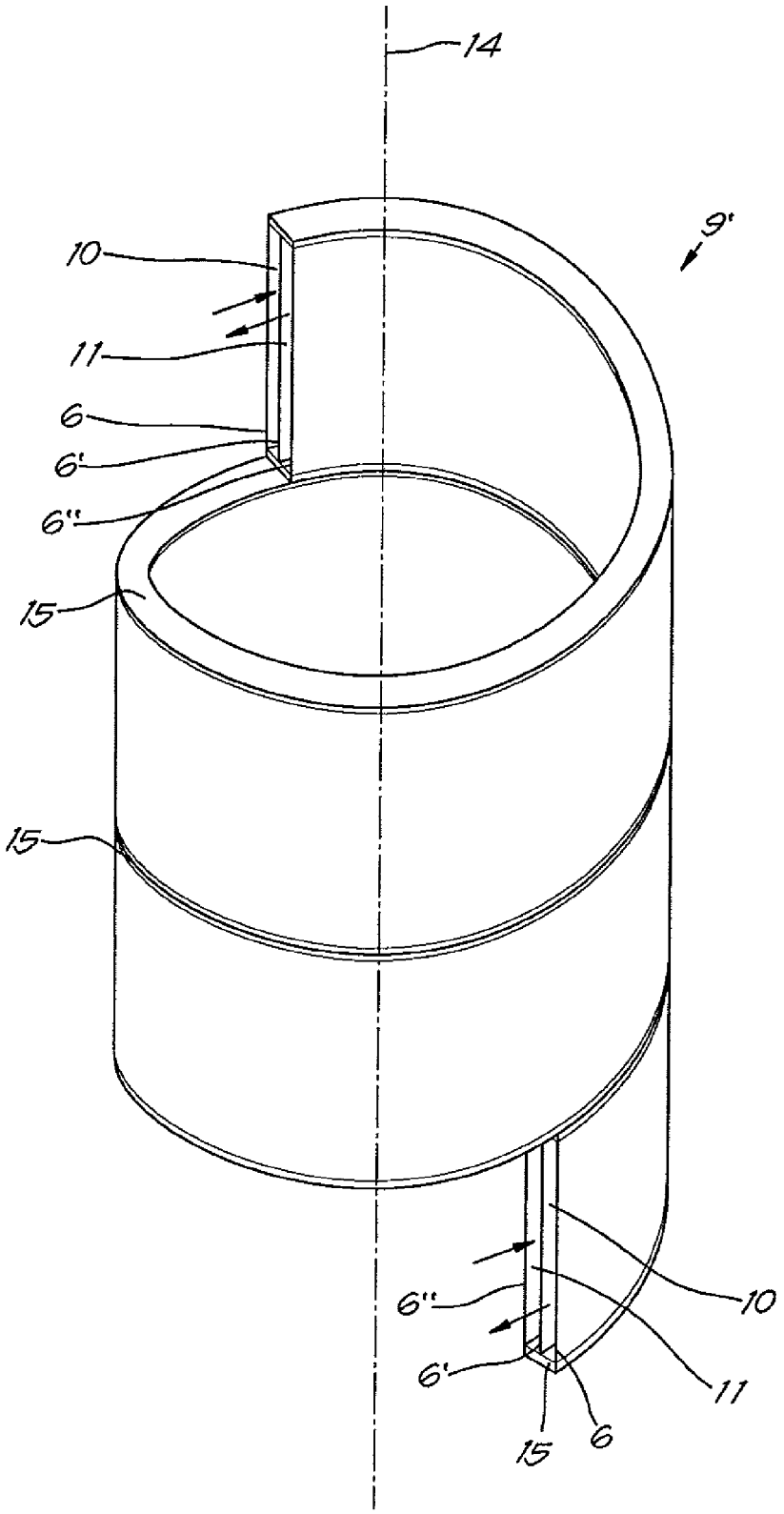
Figure 8:
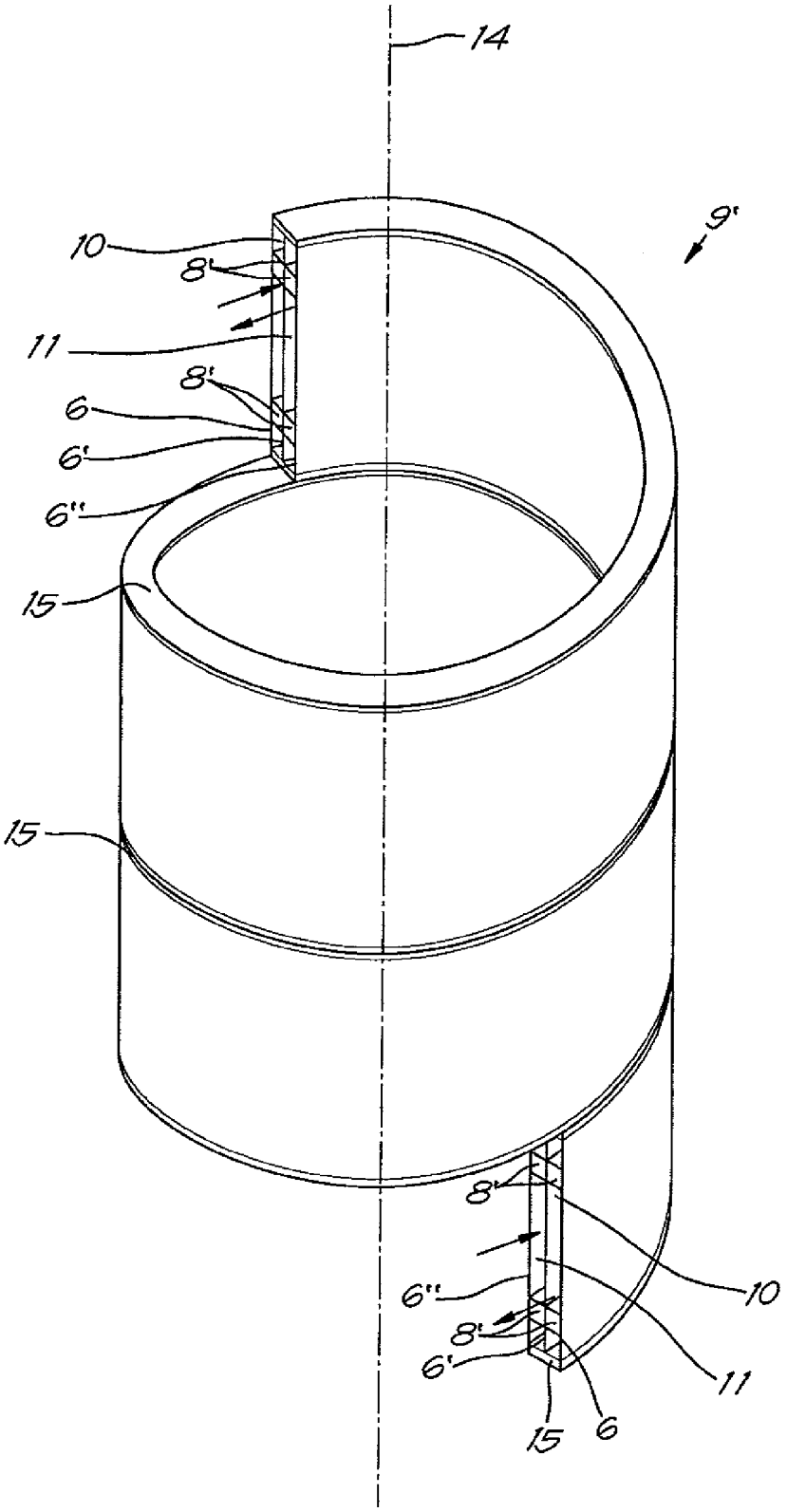

FIG. 3 shows a variant 3' of FIG. 2, whereby the same helical counterflow heat exchanger is shown, but is now provided with a second spacer that consists of rectangular strips 8' of Teflon or another chemically inert material, that extends in the flow direction of the fluids between the three helical double-sided enameled steel plates 4, 4', 4" wound around one another, and are so arranged that the edges of the steel plates do not come into contact with the flow chambers 5, 6 defined by the beam-shaped strips 8'.

The operation of the counterflow heat exchanger according to the invention is very simple and as follows.

The hotter and colder fluid can consist of a gas and/or a liquid phase of the same substance or of two different substances. The high corrosion-resistance of the enameled plates also enables chemically corrosive fluids to be sent through the heat exchanger.

For the helical embodiments 3,3' of the counterflow heat exchanger, three flexible double-sided enameled steel plates 4, 4', 4" are used, between which two chambers 5, 6 are created by holding the steel plates by the edges in a corrosion-resistant spacer 8, that not only ensures a constant distance between the three plates 4, 4', 4", but also keeps them in the right helical shape in order to wind up the chambers 5, 6 such that the windings lie against the overlying windings and both chambers 5, 6 run into the other end of the helical counterflow heat exchanger.

The hotter fluid is guided through the first chamber 5 in a first flow direction, while the colder fluid is guided through the second chamber 6 in a flow direction opposite to the first flow direction of the hotter fluid. Both chambers 5 and 6 are only separated from one another by one single separating plate 4' of flexible double-sided enameled steel through which the hotter fluid transfers heat to the colder counterflow of the second fluid that flows into the counterflow heat exchanger at the opposite end of the helical heat exchanger to the first fluid, and flows out again at the same end where the first fluid flows in.

Due to its compact construction, the helical counterflow heat exchanger 3, 3' saves space, but nonetheless provides the possibility to exchange heat over a long and smooth enamelled steel band.

It goes without saying that the second fluid can also consist of the first fluid that has already been partially cooled at the bottom of the helix and flows out of the first chamber 5 and is fed back through the second chamber 6 to the top of the helix.

The present invention is by no means limited to the embodiments described as an example and shown in the drawings, but a counterflow heat exchanger according to the invention can be realised in all kinds of forms and dimensions, without departing from the scope of the invention as defined in the claims.

The invention claimed is:

1. A helical counterflow heat exchanger, comprising:

three flexible flat monolithic double-sided enameled steel bands annealed at temperatures above 500° C., that define two chambers and are wound helically around a central longitudinal axis that is parallel with and equidistant to a surface of each respective enameled steel band, the surface of each respective enameled steel band extending parallel to the longitudinal axis, the first chamber being configured to guide a first fluid therethrough, the second chamber being configured to guide a second fluid therethrough in an opposite direction with respect to a guiding direction of the first fluid; and a first corrosion-resistant helical spacer provided between windings of the heat exchanger to impose a mutual distance between the windings and a curve of the respective windings in the heat exchanger formed by the enameled steel bands, to prevent corrosion of the steel bands at edges of the steel bands and to allow successive windings of the helical heat exchanger to fit against one another in the direction of the longitudinal axis.

2. The counterflow heat exchanger according to claim 1, further comprising a second helical spacer comprising rectangular strips of chemically-inert material, the rectangular strips extending in the flow direction of the fluids between two of the enameled steel bands wound around one another, the rectangular strips being configured such that the edges of the enameled steel bands do not come into contact with the content of the two chambers.

* * * * *